US006250979B1

(12) United States Patent
Müller

(10) Patent No.: US 6,250,979 B1
(45) Date of Patent: Jun. 26, 2001

(54) BOAT DRIVE WITH VARIABLE-PITCH PROPELLER

(75) Inventor: Peter Müller, Adliswil (CH)

(73) Assignee: NASYC Holding S.A., Luxembourg (LU)

( * ) Notice: Subject to any disclaimer, the term of this patent is extended or adjusted under 35 U.S.C. 154(b) by 0 days.

(21) Appl. No.: 09/632,280

(22) Filed: Aug. 4, 2000

(30) Foreign Application Priority Data

Aug. 5, 1999 (DE) ..... 199 36 949

(51) Int. Cl.[7] ..... B63H 5/125
(52) U.S. Cl. ..... 440/50; 416/147
(58) Field of Search ..... 440/50; 416/147, 416/155, 156, 164, 168 R

(56) References Cited

U.S. PATENT DOCUMENTS 4,744,727 * 5/1988 Muller ..... 416/164
4,897,056 * 1/1990 Muller ..... 440/50
5,073,134 12/1991 Müller ..... 440/50
5,967,753 * 10/1999 Muller ..... 440/50

* cited by examiner

*Primary Examiner*—Stephen Avila
(74) *Attorney, Agent, or Firm*—Herbert Dubno; Andrew Wilford

(57) ABSTRACT

A boat drive has a housing, a tube shaft rotatable in the housing about a shaft axis and having axially opposite front and rear ends, a hub carried on the shaft rear end, and a plurality of radially projecting vanes pivotal on the hub. An axially shiftable core shaft extending coaxially in the tube shaft has a rear end rearward of the tube-shaft rear end and a front end forward of the tube-shaft front end. Mechanism connecting the core-shaft rear end with the vanes pivots the vanes on the hub on axial displacement of the core shaft. A pair of oppositely directed axial-thrust bearings on the core-shaft front end are contained in and surrounded by a hollow piston having front and rear faces axially flanking the thrust bearings. A cylinder fixed in the housing and surrounding the piston forms with the respective faces thereof front and rear compartments so that pressurization of the front compartment shifts the core shaft rearward and pressurization of the rear compartment shifts the core shaft forward.

8 Claims, 1 Drawing Sheet

BOAT DRIVE WITH VARIABLE-PITCH PROPELLER

FIELD OF THE INVENTION

The present invention relates to a boat drive. More particularly this invention concerns such a boat drive with a variable-pitch propeller.

BACKGROUND OF THE INVENTION

As described in U.S. Pat. No. 5,073,134 a standard boat drive has a housing, a tube shaft rotatable in the housing about a shaft axis and having axially opposite front and rear ends, a hub carried on the shaft rear end, and a plurality of radially projecting vanes pivotal on the hub. An axially shiftable core shaft extending coaxially in the tube shaft has a rear end rearward of the tube-shaft rear end and a front end forward of the tube-shaft front end. Mechanism connecting the core-shaft rear end with the vanes pivots the vanes on the hub on axial displacement of the core shaft. An axial-thrust bearing on the core-shaft front end is connected via another coaxial shaft to a piston having front and rear faces exposed in respective front and rear compartments formed by a cylinder fixed in the housing and surrounding the piston. Thus pressurization of the front compartment shifts the core shaft rearward and pressurization of the rear compartment shifts the core shaft forward.

The problem with this construction is that it is axially quite long. This makes it impossible to incorporate in an outboard drive, and even fairly complex in inboard or other drive types.

OBJECTS OF THE INVENTION

It is therefore an object of the present invention to provide an improved boat drive.

Another object is the provision of such an improved boat drive which overcomes the above-given disadvantage, that is which is relatively short.

SUMMARY OF THE INVENTION

A boat drive has according to the invention a housing, a tube shaft rotatable in the housing about a shaft axis and having axially opposite front and rear ends, a hub carried on the shaft rear end, and a plurality of radially projecting vanes pivotal on the hub. An axially shiftable core shaft extending coaxially in the tube shaft has a rear end rearward of the tube-shaft rear end and a front end forward of the tube-shaft front end. Mechanism connecting the core-shaft rear end with the vanes pivots the vanes on the hub on axial displacement of the core shaft. A pair of oppositely directed axial-thrust bearings on the core-shaft front end are contained in and surrounded by a hollow piston having front and rear faces axially flanking the thrust bearings. A cylinder fixed in the housing and surrounding the piston forms with the respective faces thereof front and rear compartments so that pressurization of the front compartment shifts the core shaft rearward and pressurization of the rear compartment shifts the core shaft forward.

Since the bearings are inside the piston, the entire assembly can be greatly reduced in length. In addition the provision of extra structure between the axial-thrust bearings and the piston is eliminated, further simplifying the structure.

The core-shaft front end according to the invention has a radially projecting flange braced against and lying between the bearings. The piston has an axially extending sleeve coaxially extending through one of the compartments and surrounding the core shaft. Formations on the sleeve and housing inhibit rotation of the sleeve and piston relative to the housing. These formations are splines.

The cylinder according to the invention has a removable front end cap forming a front wall of the front compartment. Similarly the piston includes a forwardly open cup containing the bearings and a removable front plate closing the cup and forming the front face. A passage through the tube shaft for lubricating a space between the core shaft and tube shaft.

BRIEF DESCRIPTION OF THE DRAWING

The above and other objects, features, and advantages will become more readily apparent from the following description, reference being made to the accompanying drawing whose sole FIGURE is an axial section through a boat drive according to the invention.

SPECIFIC DESCRIPTION

Figure 1:
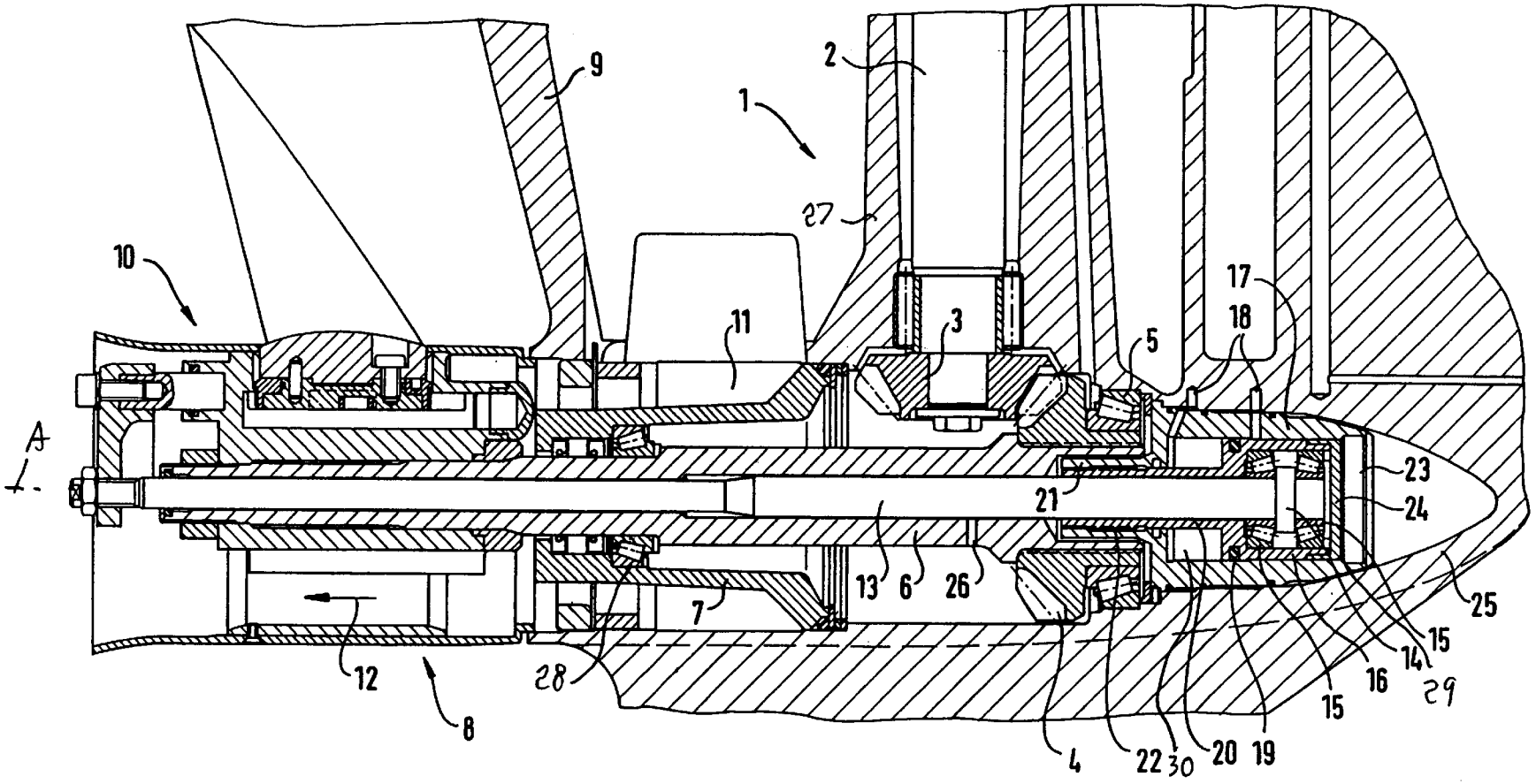

As seen in the drawing a boat drive 1 has a housing 27 which may form part of an outboard motor, an inboard/outboard drive, or a simple drive-carrying boat skeg. A vertical drive shaft 2 extends down through the housing 27 and has a lower end carrying a bevel gear 3 meshing with a bevel gear 4 carried on a tube shaft 6 extending along a drive axis A and braced axially forward by a thrust bearing 5 against the housing 27 and axially backward via another axial thrust bearing 28 against a part 7 of the housing 27. The housing 27 is formed with passages 11 allowing exhaust gases from the unillustrated engine to be vented underwater as shown by arrows 12.

The rear end of the tube shaft 6 carries a hub 8 from which extend a plurality of vanes 9 (only one shown) pivotal about respective axes on the hub 8 by an adjustment mechanism 10 of the type described in above-cited U.S. Pat. No. 5,073,134. The adjustment mechanism 10 is operated by a core shaft 13 centered on the axis A coaxially inside the tube shaft 6 and having a rear end extending axially rearward past a rear end of the shaft 6 and connected to the mechanism 10 and a front end extending axially forward past a front end of the shaft 6.

A flange 14 formed on the shaft 13, which rotates jointly with the shaft 6, is received between axial-thrust bearings 15 in a piston sleeve 16 axially reciprocal in a cylinder 17 fixed in the housing 27. Separate feed passages 18 opening to opposite sides of a seal ring 19 set in the piston 16 allow a front compartment 29 or a back compartment 30 to be pressurized to move the rod 13 axially backward or forward, respectively. A cap 24 closes the front end of the piston and forms its front face and a removable end plug 23 closes the front end of the front compartment 29. The portion of the piston 16 forward of the seal ring 19 has a slightly smaller diameter than the portion rearward thereof.

This piston 16 has an axially rearwardly extending sleeve 20 closely surrounding the shaft 13 and sliding axially in a sleeve 21 of the cylinder 17 via splines 22 so that the piston 16 can move axially relative to the cylinder 17 and housing 27 but not rotate about the axis A therein. A radial bore 26 in the core shaft 6 allows the space between it and the shaft 13 and the bearings 14 to be lubricated.

With this system, therefore, pressurization of the compartment 29, which normally has a slightly smaller effective surface area on the piston 16 than the compartment 30, pushes the shaft 13 backward in the shaft 6 and rotates the vanes 9 in one direction and pressurization of the compartment 30 has the opposite effect.

I claim:

1. A boat drive comprising:

a housing;

a tube shaft rotatable in the housing about a shaft axis and having axially opposite front and rear ends;

a hub carried on the shaft rear end;

a plurality of radially projecting vanes pivotal on the hub;

an axially shiftable core shaft extending coaxially in the tube shaft and having a rear end rearward of the tube-shaft rear end and a front end forward of the tube-shaft front end;

means connecting the core-shaft rear end with the vanes for pivoting the vanes on the hub on axial displacement of the core shaft;

a pair of oppositely directed axial-thrust bearings on the core-shaft front end;

a hollow piston surrounding and containing the thrust bearings and having front and rear faces axially flanking the thrust bearings; and a cylinder fixed in the housing, surrounding the piston, and forming with the respective faces thereof front and rear compartments, whereby pressurization of the front compartment shifts the core shaft rearward and pressurization of the rear compartment shifts the core shaft forward.

2. The boat drive defined in claim 1 wherein the coreshaft front end has a radially projecting flange braced against and lying between the bearings.

3. The boat drive defined in claim 1 wherein the piston has an axially extending sleeve coaxially extending through one of the compartments and surrounding the core shaft.

4. The boat drive defined in claim 3 further comprising formations on the sleeve and housing inhibiting rotation of the sleeve and piston relative to the housing.

5. The boat drive defined in claim 4 wherein the formations are splines.

6. The boat drive defined in claim 1 wherein the cylinder has a removable front end cap forming a front wall of the front compartment.

7. The boat drive defined in claim 1 wherein the piston includes a forwardly open cup containing the bearings and a removable front plate closing the cup and forming the front face.

8. The boat drive defined in claim 1 further comprising means including a passage through the tube shaft for lubricating a space between the core shaft and tube shaft.

* * * * *